US010054403B2

(12) United States Patent
Backström et al.

(10) Patent No.: US 10,054,403 B2
(45) Date of Patent: Aug. 21, 2018

(54) METHOD AND ARRANGEMENT FOR THREAT MANAGEMENT FOR GROUND-BASED VEHICLE

(71) Applicant: BAE Systems Hägglunds Aktiebolag, Örnsköldsvik (SE)

(72) Inventors: Ronny Backström, Umeå (SE); Gösta Svensson, Örnsköldsvik (SE)

(73) Assignee: BAE SYSTEMS Hägglunds Aktiebolag, Örnsköldsvik (SE)

( * ) Notice: Subject to any disclaimer, the term of this patent is extended or adjusted under 35 U.S.C. 154(b) by 379 days.

(21) Appl. No.: 14/770,055

(22) PCT Filed: Feb. 20, 2014

(86) PCT No.: PCT/SE2014/050209
§ 371 (c)(1),
(2) Date: Aug. 24, 2015

(87) PCT Pub. No.: WO2014/129961
PCT Pub. Date: Aug. 28, 2014

(65) Prior Publication Data

US 2016/0010955 A1 Jan. 14, 2016

(30) Foreign Application Priority Data

Feb. 25, 2013 (SE) ..... 1350219

(51) Int. Cl.
*F41H 11/00* (2006.01)
*F41H 7/02* (2006.01)

(52) U.S. Cl.
CPC ..... *F41H 11/00* (2013.01); *F41H 7/02* (2013.01)

(58) Field of Classification Search
CPC ..... F41H 7/02; F41H 11/00
See application file for complete search history.

(56) References Cited

U.S. PATENT DOCUMENTS 6,903,676 B1 6/2005 Frady et al.
2004/0061595 A1 4/2004 Yannone et al.
(Continued)

FOREIGN PATENT DOCUMENTS

GB 2410786 A 8/2005
WO 2007/093224 A1 8/2007
WO 2008/103878 A1 8/2008

OTHER PUBLICATIONS

Extended European Search Report (includes supplementary European search report and European search opinion) received for European Patent Application No. 14754527.1, dated Sep. 1, 2016, 7 Pages.

(Continued)

*Primary Examiner* — Nicholas Kiswanto
(74) *Attorney, Agent, or Firm* — Morrison & Foerster LLP

(57) ABSTRACT

The invention pertains to a method for threat handling of a ground based vehicle, comprising the steps of providing at least two kinds of systems for said threat handling, wherein said threat handling comprises determining information about said threat and determining actions for handling said threats based upon said information, and providing a control unit for controlling provided systems, providing a separate hardware safety configuration unit, and providing said separate hardware safety configuration unit with by means of provided means determined information about said threat so as to in an evaluation step deciding if said control unit should be given a go ahead for handling said threat or not. The invention also relates to a computer program product comprising program code for a computer implementing a method according to the invention. The invention also relates to a device and a ground based vehicle which is equipped with the device.

18 Claims, 4 Drawing Sheets

(56) References Cited

U.S. PATENT DOCUMENTS

2010/0253567 A1* 10/2010 Factor ..... G01S 7/36
342/52
2012/0217301 A1 8/2012 Namey et al.

OTHER PUBLICATIONS

International Search Report and Written Opinion received for PCT Patent Application No. PCT/SE2014/050209 dated May 21, 2014, 10 pages.
International Preliminary Report on Patentability received for PCT Patent Application No. PCT/SE2014/050209 dated Sep. 3, 2015, 7 pages.

* cited by examiner

METHOD AND ARRANGEMENT FOR THREAT MANAGEMENT FOR GROUND-BASED VEHICLE

CROSS REFERENCE TO RELATED APPLICATIONS

This application is a U.S. National Stage patent application of PCT/SE2014/050209, filed on Feb. 20, 2014, which claims priority to Swedish Patent Application No. 1350219-0, filed on Feb. 25, 2013, the entire contents of which are incorporated herein by reference.

FIELD OF THE INVENTION

The present invention relates to a method for threat handling of a ground based vehicle. The invention also relates to a computer program product comprising program code for a computer implementing a method according to the invention. The invention also relates to a device for threat handling of a ground based vehicle and a motor vehicle which is equipped with the device.

BACKGROUND OF THE INVENTION

Military ground vehicles of today may be exposed to various kinds of threats. Said threats may be real threats during for example a combat situation. Said threats can be fictive threats during for example a combat exercise. The threats may be of various kinds. The threats may for example be other, hostile, military ground vehicles, helicopters, different weapon systems or troops.

Such vehicles may be equipped with counter-measure systems for neutralizing threats. These counter-measure systems are denoted "hard-kill" systems. A hard-kill system may comprise an anti-aircraft system or a reactive armour, which can blow up an incoming projectile.

Such vehicles may also be equipped with counter-measure systems for at least avoiding to be defeated or in any other way be negatively affected by for example interference with own systems. These counter-measure systems are denoted "soft-kill" systems. A soft-kill system may for example comprise a smoke unit for providing a screening smoke screen. A soft-kill system may for example comprise equipment for blending a threat and hereby make it harder for the threat to act in a planned way.

A collective term for hard-kill systems and "soft-kill" systems is affect and counter-measure systems. Different affects and counter-measure systems are today known. Many such systems comprise so called "Plug and-Play" functionality. Hereby different sub systems with standardised interfaces may be installed in vehicles. Systems comprising Plug and Play units are fairly easy to build, operate and maintain.

In for example the military vehicle industry it is quite common to use so called "off the shelf" or "bolt-on" products. These do not comprise standardised interfaces for easy integration in systems on-board vehicles. These products may also be denoted "stand alone" products. These products are relatively expensive and are in general not configured for communication with each other or other products in an existing system of the vehicle.

Today there is a quite large demand of vehicles which are specially developed, i.e. where many stand alone products are used. This naturally creates problems regarding component integration of vehicles where different sub systems, sensor configurations etc are not of the Plug and Play type.

One of the difficulties with integrating stand alone components is associated with the safety critical aspects. It is time demanding and resource demanding to develop software which has to be certified as safety critical. Installation of stand alone products in existing systems of a vehicle may hereby demand extensive adaption of software in a control unit.

U.S. Pat. No. 7,049,998 depicts a defense system for ships, which defense system is formed by means of integrating of generally available sub systems which can provide "plug and play" capacity.

US 2004/0061595 depicts a decision support system of ground based combat vehicles.

SUMMARY OF THE INVENTION

An object of the present invention is to provide a novel and advantageous method for threat handling of a ground based vehicle.

Another object of the invention is to provide a novel and advantageous device and a new and advantageous computer program for threat handling of a ground based vehicle.

Yet another object of the invention is to provide a method, a device and a computer program for achieving a more robust threat handling of a ground based vehicle.

Yet another object of the invention is to provide a method, a device and a computer program for achieving a safer ground based vehicle.

Yet another object of the invention is to provide a method, a device and a computer program for achieving a versatile ground based vehicle which may handle various kinds of threats.

Yet another object of the invention is to provide an alternative method, an alternative device and an alternative computer program for threat handling of ground based vehicles.

These objects are achieved by a method for threat handling of a ground based vehicle.

According to an aspect of the invention there is provided a method for threat handling of a ground based vehicle, comprising the steps of:

- providing at least two kinds of systems for said threat handling, where said threat handling comprises determining information about said threat and determining actions for handling of said threat depending on said information;
- providing a control unit for controlling provided systems;
- providing a separate hardware safety configuration unit;
- feeding said separate hardware safety configuration unit with by means of provided systems determined information about said threat so as to in an evaluation step deciding if said control unit should be given a go ahead for handling said threat or not.

Hereby is advantageously achieved functionality and performance of sensors and actuating means of said two kinds of systems for said threat handling, which sensors and actuating means may be used to a greater extent in combination with existing vehicle functions.

Hereby safety critical functionality is encapsulated in said hardware safety configuration unit, which provides reduced integration cost and delivery time of the vehicle as a result.

Advantageously there is provided both a standardised process for integration of components and equipment of said two different kinds of systems and improved user-friendliness, availability and reliability.

Said control unit may be a so called DAS-controller. Hereby is allowed an easy-to-use DAS system with integrated DAS-functionality. Said control unit is arranged to control and monitor integrated DAS-systems in the form of any of said at least two different systems. Said control unit may hereby incorporate DAS-systems from a data logical point of view, wherein said control unit is handling communication with for example information systems and control systems of the vehicle.

Hereby is effectively provided a possibility to integrate so called "stand alone" sensors and to use other existing sensors of the vehicle handled by the control unit.

Said control unit can handle all data logical interfaces for controlling hard-kill systems and soft-kill systems of the type "off the shelf" and/or "bolt on". Said control unit is arranged to handle start up of the system, various DAS-modes and some user interaction, but also sensor management and data fusion processes regarding data from various sensors of the vehicle, where applicable.

Said hardware safety configuration unit may be a so called Control Enabling Safety Circuit (CESC). Said hardware safety configuration unit can provide an interface for reliable integration of "off the shelf" products, where safety technology is incorporated in said hardware safety configuration unit and said integrated products. The inventive architecture further allows an extended functionality by shared use for the control unit and said hardware safety configuration unit regarding sensors and actuating means of the integrated products.

A system pertaining to the method may be a so called hard-kill system for defeating threats. A system pertaining to the method may be a so called soft-kill system for avoiding threats.

Said vehicle may be a combat vehicle, for example a tank. Said vehicle may be a suitable ground vehicle. Said vehicle may be a terrain vehicle or an amphibian vehicle.

The method may further comprise the step of:

by means of said control unit controlling provided system for automatic handling of said threat and/or semi-automatic handling of said threat. Hereby is provided a versatile functionality of said ground vehicle where an operator by means of suitable means can choose operation mode of the vehicle, for example an automatic mode or a semi-automatic mode.

It should be noted that some steps of an automatic handling of said threat can be semi-automatic or manual. For example, directing of a barrel of the vehicle may be set for affecting said threat, where the step of firing of a projectile can be manual or semi-automatic. Hereby is achieved a safe system, where an operator of the vehicle can take some decisions, for example firing arms for handling of such a threat.

According to an aspect of the present invention a suitable number of different counter-measures may be activated and used in sequence. For example, a counter-measure sequence may comprise the functions blinding, smoke screen, evasive manoeuvres and defeating of incoming threats.

According to an aspect of the present invention a suitable number of different counter-measures may be activated and used substantially simultaneously. For example at least two of said counter-measure functions blinding, smoke screen, evasive manoeuvres and defeating of incoming threats may be performed simultaneously.

The method may further comprise the step of:

connecting as well as the hardware safety configuration unit as said control unit to provided systems for transferring of information. Hereby is advantageously achieved redundancy according to the inventive method. Hereby said hardware safety configuration unit can ensure that said control unit, for example in the case where a bug is present in stored software, is not performing any operation of said hard-kill system or soft-kill system in an undesirable way. Hereby is achieved a safe method for handling of threat according to an aspect of the invention.

Information transfer from said hardware safety configuration unit to said control unit may be one-directional. Hereby said control unit may only read information from said hardware safety configuration unit according to an embodiment of the invention. Hereby is determined that said control unit cannot affect processes and decisions of said hardware safety configuration unit. Hereby is achieved a reliable method according to an aspect of the invention.

Said control unit may be arranged to be provided with information of one kind by provided systems for controlling another kind of provided systems. Hereby said control unit can have access to required information for controlling at least one hard-kill system and/or at least one soft-kill system of the vehicle in an effective way.

The method is easy to implement in existing motor vehicles. Software for threat handling of a ground based vehicle according to the invention may be installed in a control unit of the vehicle during manufacturing. A buyer of the vehicle may thus get the possibility to choose the methods function as an additional option. Alternatively, software comprising program code for performing the innovative method for threat handling of a ground based vehicle may be installed in a control unit of the vehicle when upgrading at a service station. In this case the software may be loaded into a memory in the control unit.

Software comprising program code for threat handling of a ground based vehicle may easily be updated or exchanged. Further, various parts of the software comprising program code for threat handling of a ground based vehicle may be exchanged independently of each other. This modular configuration is advantageous from a maintenance perspective.

According to an aspect of the invention there is provided a device for threat handling of a ground based vehicle, comprising:

at least two kinds of systems for said threat handling;

means adapted to determine information about said threat;

means adapted to determine actions for handling of said threat depending on said information;

a control unit for controlling provided systems;

a separate hardware safety configuration unit;

means adapted to provide said separate hardware safety configuration unit with by means of provided systems determined information about said threat; and means adapted to determine if said control unit should be given a go ahead for handling said threat or not.

Said control unit may be a DAS controller. Said hardware safety configuration unit may be a safety classified hardware unit. According to an embodiment said hardware safety configuration unit may comprise so called CPLD-code. Even when said hardware safety configuration unit comprises CPLD code.

According to an aspect of the present invention there is provided an architecture having a DAS-controller and a Control Enabling Safety Circuit mechanism for integration of hard-kill systems and soft-kill systems which are of the type "off the shelf". Advantageously there is provided a DAS-architecture having several levels of counter-measures where functionalities of hard-kill systems and soft-kill systems may be combined. Hereby performance of the total system advantageously may be improved.

One kind of system may be a so called hard-kill system for defeating threats, and whereby one kind of system may be a so called soft-kill system for avoiding threats.

Said vehicle may be a combat vehicle, for example a tank.

Said control unit may be adapted for controlling provided systems for automatic and/or semi-automatic handling of said threats.

The device may further comprise:

means adapted to connect said hardware safety configuration unit as well as said control unit to provided systems for information transfer.

Said hardware safety configuration unit may be adapted for one-directional information transfer to said control unit.

Said control unit may be adapted to receive information from one kind of provided systems and control another kind of provided systems on the basis of said received information.

The above presented objects are also achieved by a vehicle comprising a device.

Said vehicle may be any kind of combat vehicle, terrain vehicle or other military vehicle.

According to an aspect of the invention there is provided a computer program for threat handling of a ground based vehicle, where said computer program comprises a program code stored on a by a computer readable medium for causing an electronic control unit to perform the steps of:

determining information about said threat;

determining actions for handling of said threat depending on said information;

controlling provided systems for automatic and/or semi-automatic handling of said threat on basis of a by means of a by a separate hardware safety configuration unit determined decision about a go ahead should be given for handling said threat or not.

Said hardware safety configuration unit may be a hardware unit without stored software. Said hardware safety configuration unit may be a hardware unit which must be associated with a relatively high safety classification. Said control unit may be a unit which does not have to be associated with a relatively high safety classification.

According to an aspect of the invention there is provided a computer program for threat handling of a ground based vehicle, where said computer program comprises a program code for causing an electronic control unit to perform the steps of:

determining information about said threat;

determining actions for handling of said threat depending on said information;

controlling provided systems for automatic and/or semi-automatic handling of said threat on basis of a by means of a separate hardware safety configuration unit determined decision about a go ahead should be given for handling said threat or not.

Said hardware safety configuration unit may be a hardware unit without stored software. Said hardware safety configuration unit may be a hardware unit which must be associated with a relatively high safety classification. Said control unit may be a unit which does not have to be associated with a relatively high safety classification.

According to an aspect of the invention there is provided a computer program product comprising a program code stored on a by a computer readable medium for performing the method steps of:

determining information about said threat;

determining actions for handling of said threat depending on said information;

controlling provided systems for automatic and/or semi-automatic handling of said threat on basis of a by means of a separate hardware safety configuration unit determined decision about a go ahead should be given for handling said threat or not, when said computer program is run on an electronic control unit.

Said hardware safety configuration unit may be a hardware unit without stored software. Said hardware safety configuration unit may be a hardware unit which must be associated with a relatively high safety classification. Said control unit may be a unit which does not have to be associated with a relatively high safety classification. Said computer program product does not have to be associated with a relatively high safety classification.

Further objects, advantages and novel features of the present invention will become apparent to one skilled in the art from the following details, and also by putting the invention in practice. Wherein the invention is described below, it should be noted that it is not restricted to the specific details described. Specialists having access to the teachings herein will recognize further applications, modifications and incorporations within other fields, which are within the scope of the invention.

BRIEF DESCRIPTION OF THE DRAWINGS

For a fuller understanding of the present invention and further objects and advantages of it, the detailed description set out below should be read together with the accompanying drawings, in which the same reference notations denote similar items in the various diagrams, and in which.

DETAILED DESCRIPTION OF THE INVENTION

Figure 1:
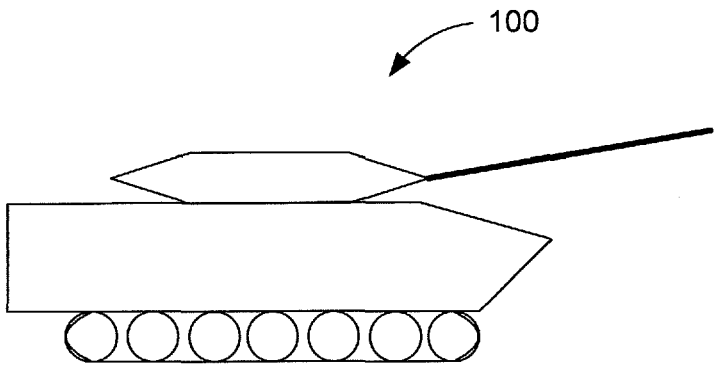
FIG. 1 schematically illustrates a vehicle, according to an embodiment of the invention.

With reference to FIG. 1 there is illustrated a side view of a vehicle 100. The vehicle 100 is a ground based vehicle. The vehicle 100 may be of any suitable kind. According to one embodiment said vehicle 100 is a military vehicle. According to an embodiment said vehicle 100 is a terrain vehicle. According to an embodiment the vehicle 100 is chosen from the group tank, tracked vehicle, infantry arms vehicle, amphibian vehicle, artillery vehicle and command centre vehicle. The vehicle 100 may comprise caterpillar and/or wheels for propelling said vehicle.

Herein the term "link" refers to a communication link which may be a physical wire, such as an opto-electronic communication wire, or a non-physical wire, such as a wireless connection, for example a radio- or microwave link.

Figure 2:
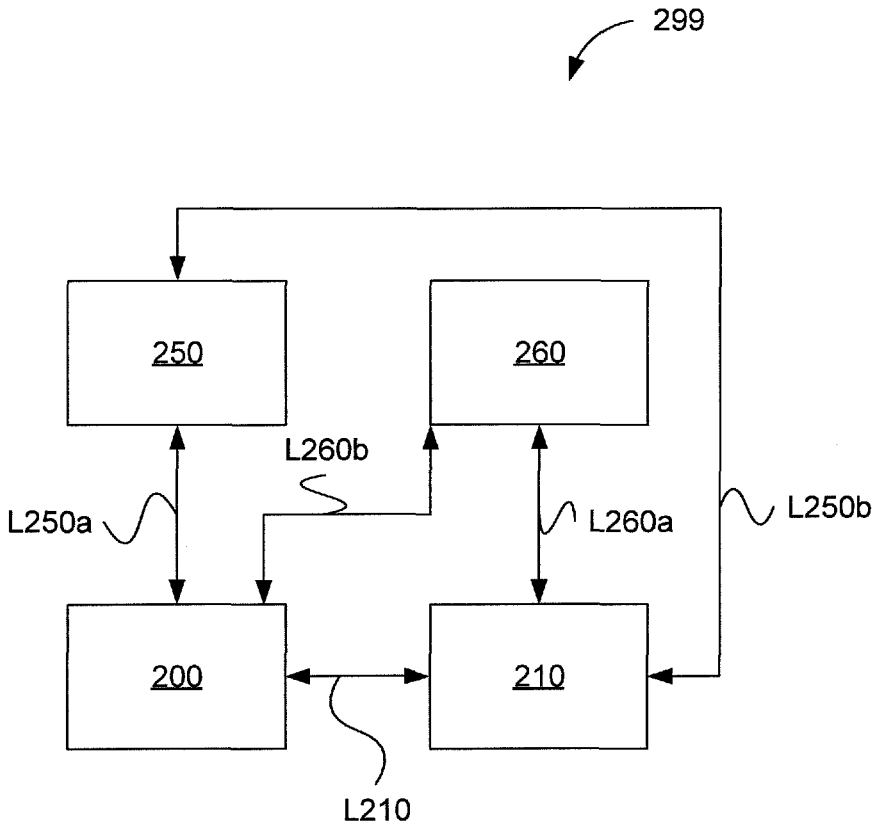
FIG. 2 schematically illustrates a device for threat handling of a ground based vehicle, according to an embodiment of the invention.

According to FIG. 2 there is illustrated a device 299 for threat handling of the vehicle 100. The device 299 is arranged in the vehicle 100.

The device 299 comprises an electronic control unit 200. The control unit 200 may according to an embodiment be a so called DAS-controller. The control unit 200 is arranged to control and monitor a number of different sub systems of the vehicle 100. A schematic example is depicted with reference to FIG. 5 below.

The device 299 comprises at least a first sub system 250 of a first category. Said control unit 200 is arranged for communication with the first sub system 250 via a link L250*a*. Said control unit 200 is arranged to control and monitor said first sub system 250. The at least one sub system 250 is a so called hard-kill system. Said first sub system 250 may comprise devices for neutralizing threats, such as incoming missiles, robots, grenades or projectiles. Said first sub system 250 may comprise devices for neutralizing threats such as for example hostile vehicles, ships, airplanes or helicopters. Said first sub system 250 may comprise devices for neutralizing threats, such as troops or individual soldiers. Said devices may be of any suitable kind. Said devices may for example comprise an anti-aircraft system.

The device 299 comprises at least one sub system 260 of a second category. The at least one second sub system 260 is a so called soft-kill system. Said control unit 200 is arranged for communication with the second sub system 260 via a link L260*a*. Said control unit 200 is arranged to control and monitor said second sub system 260. Said second sub system 260 may comprise devices for allowing evasive manoeuvres of the vehicle so as to escape threats. Said second sub system 260 may comprise devices for performing vehicle concealing actions, for example by means of smoke projectiles. Said second sub system 260 may comprise devices for performing misleading actions, such as i.e. firing IR-torches or magnesium strips.

Said first sub system and said second sub system is depicted in greater detail with reference to FIG. 3 below.

Some sensors of the vehicle 100 may be parts of both said first sub system 250 and said second sub system 260 as a shared resource.

The control unit 200 is arranged for communication with a safety unit 210 via a link L210. According to an embodiment said control unit 200 and said safety unit may be arranged for two-way communication with each other via said link L210. According to an embodiment said control unit 200 and said safety unit 210 may be arranged for one-way communication with each other via said link L210, where only said safety unit 210 is arranged to, where applicable, send a signal 51 to the control unit 200. Said signal 51 may comprise information about that said control unit 200 is given a go ahead to handle a determined threat or not.

Said safety unit 210 may comprise a Control Enabling Safety Circuit mechanism. Said safety unit 210 may also be denoted hardware safety configuration unit. Said safety unit 210 is arranged for communication with said first sub system 250 via a link L250*b*. Said safety unit 210 is arranged for communication with said second sub system 260 via a link L260*b*.

Said safety unit 210 is a hardware unit. Said safety unit 210 comprises according to an embodiment no software. Said safety unit 210 comprises an electrical circuit of suitable architecture. According to an embodiment said safety circuit may comprise CPLD code. Hereby said safety unit 210 still is considered to be only hardware. Said safety unit 210 may advantageously be certified according to a highest level of safety classification. Said safety unit 210 is arranged to receive signals from sensor configurations incorporated in both said at least one first sub system 250 and said at least one second sub system 260. Said safety unit 210 is configured so that this can evaluate information in said received signals and decide whether the control unit 200 should be given a go ahead to control operation of said at least one first sub system 250 and/or said at least one second sub system 260. Hereby the safety unit 210 may be arranged to, where applicable, give the control unit 200 permission to perform certain actions for handling a determined threat.

According to an example embodiment the safety unit 210 may be arranged to activate at least one suitable counter-measure, of said first sub system 250 and/or second sub system 260. According to one example embodiment the safety unit 210 may be arranged to activate at least one suitable counter-measure, of said first sub system 250 and/or second sub system 260 on the basis of signals received from sensors on board a vehicle 100.

According to one embodiment some sensor configurations are only incorporated in a hard-kill system or a soft-kill system. Sensor configurations for hard-kill systems may be adapted to discover a threat within a shorter range than sensor configurations for soft-kill systems. Sensor configurations for hard-kill systems may be adapted to discover a threat at a later stage than sensor configurations for soft-kill systems. According to an embodiment of the invention sensor data from a hard-kill system may advantageously be used for operating a soft-kill system of the vehicle 100. Hereby the safety unit 210 may be arranged to activate some suitable parts of a software system on the basis of sensor data from one or more hard-kill systems.

According to an embodiment of the invention sensor data from said at least one first sub system 250 may advantageously be used for operating at least one second sub system 260 of the vehicle 100. Hereby the safety unit 210 may be arranged to activate some relevant parts of said second system 260 on the basis of sensor data from one or more first sub systems 250.

Sensor configurations for soft-kill systems may be adapted to discover a threat at a longer distance than sensor configurations for hard-kill systems. Sensor configurations for soft-kill systems may be adapted to discover a threat at an earlier stage than sensor configurations for hard-kill systems. According to an embodiment of the invention sensor data from a soft-kill system may advantageously be used for operating a hard-kill system of the vehicle 100. Hereby the safety unit 210 may be arranged to activate some suitable parts of a hard-kill system on the basis of sensor data from one or more soft-kill systems.

According to an embodiment of the invention sensor data from said at least one second sub system 250 may advantageously be used for operating at least one first sub system 260 of the vehicle 100. Hereby the safety unit 210 may be arranged to activate some suitable parts of said first system 260 on the basis of sensor data from one or more second sub systems 250.

Hereby it should be noted that said control unit 200 cannot perform counter-measure actions regarding a determined threat if not said safety unit gives permission. Said control unit 200 may only take action by means of said first system 250 and/or said second system 260 if said safety unit has sent the signal 51 comprising information about that a certain threat can be handled.

Figure 3:
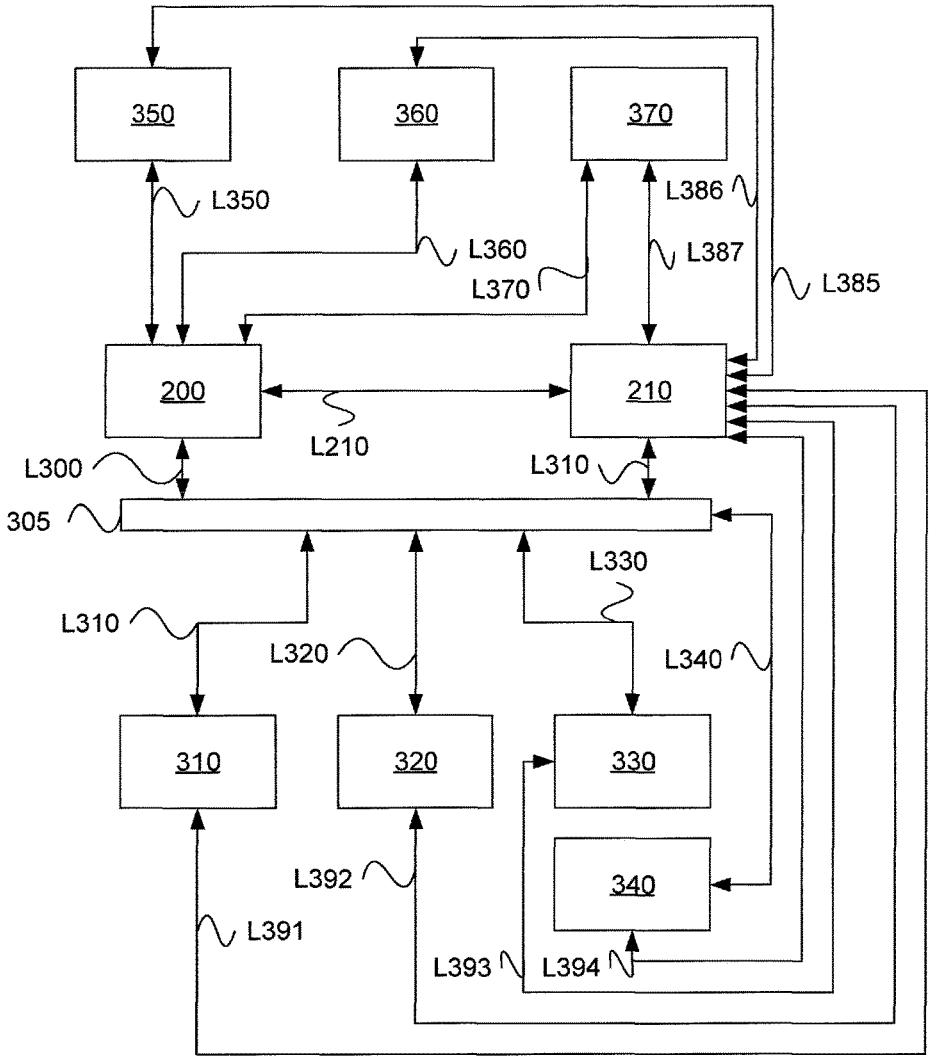
FIG. 3 schematically illustrates a device for threat handling of a ground based vehicle, according to an embodiment of the invention.

With reference to FIG. 3 the device 299 illustrated in FIG. 2 is illustrated in further detail.

The control unit 200 is arranged to continuously determine presence of threats. Said threat may be of various kinds, for example a tank, missile, grenade, robot, laser illumination, airplane, grenade rifle, grenade launcher or hostile troops.

Said control unit 200 may be arranged to automatically determine presence of threat on the basis of information determined by a first sensor configuration 310, second sensor configuration 320, third sensor configuration 330 and/or fourth sensor configuration 340, which are depicted in greater detail below. Said control unit 200 may be arranged to automatically determine information about threat characteristics. Said threat characteristics are associated with said threat. Said threat characteristics may be of any suitable kind. For example said threat characteristics may comprise information about equipment, performance and arms of a hostile vehicle or a soldier.

Said control unit 200 is arranged to automatically determine information about said threat characteristics on the basis of information determined of said first sensor configuration 310, second sensor configuration 320, third sensor configuration 330 and/or fourth sensor configuration 340. According to an embodiment information about threat characteristics may be associated with a certain threat being stored in a memory of said control unit 200. According to an embodiment said information about for example equipment, performance and arms for certain threats for example specific military vehicles, may be stored in a memory of said control unit 200.

Said control unit 200 is arranged to:

determine information about said threat;

determine actions for handling of said threat depending upon said information;

controlling provided systems for automatic and/or semi-automatic handling of said threat on the basis of a by means of a separate hardware safety configuration unit determined decision about a go ahead should be given for handling said threat or not.

Hereby the safety unit 210 is arranged for communication with the control unit via said link L210. The safety unit 210 may be denoted hardware safety configuration unit.

Said first sensor configuration 310 is arranged for communication with a connection configuration 305 via a link L310. Said second sensor configuration 320 is arranged for communication with the coupling configuration 305 via a link L320. Said third sensor configuration 330 is arranged for communication with the connection configuration 305 via a link L330. Said fourth sensor configuration 340 is arranged for communication with the connection configuration 305 via a link L340. Said connection configuration 305 is arranged for communication with the control unit 200 via a link L300. Said connection configuration 305 is arranged for communication with the safety unit 210 via a link L310. Said connection configuration may be a coupling box. Hereby the first sensor configuration 310 is arranged to continuously or intermittently send signals to the control unit 200 and the safety unit 210 via said coupling configuration 305. Hereby the second sensor configuration 320 is arranged to continuously or intermittently send signals to the control unit 200 and the safety unit 210 via said coupling configuration 305. Hereby the third sensor configuration 330 is arranged to continuously or intermittently send signals to the control unit 200 and the safety unit 210 via said coupling configuration 305. Hereby the fourth sensor configuration 340 is arranged to continuously or intermittently send signals to the control unit 200 and the safety unit 210 via said coupling configuration 305.

According to an embodiment said coupling configuration 305 may be omitted, whereby said four sensor configurations 310, 320, 330 and 340 may be connected directly to a control unit 200 and safety unit 310. Hereby said four sensor configurations 310, 320, 330 and 340 may be connected directly to the safety unit 210 via suitable links L391, L392, L393 and L394, respectively. According to one embodiment some sensor configurations 310, 320, 330 and 340 may be connected directly to said control unit 200 and said safety unit 210 while other sensor configurations may be connected to said control unit 200 and said safety unit 200 via said coupling configuration 305.

According to the example illustrated with reference to FIG. 3 said first sensor configuration 310, second sensor configuration 320 and third sensor configuration 330 is incorporated in at least one first sub system 250, which comprises a hard-kill system. According to the example illustrated with reference to FIG. 3 said fourth sensor configuration 340 is incorporated in at least one second sub system 260, which comprises a soft-kill system.

According to the example illustrated with reference to FIG. 3 said a first counter-measure configuration 350 and a second counter-measure configuration 360 is incorporated in at least a first sub system 250, which comprises a hard-kill system. According to the example illustrated with reference to FIG. 3 said third counter-measure configuration 370 is incorporated in at least one second sub system 260, which comprises a soft-kill system.

The control unit 200 is arranged for communication with a first sensor configuration 310 via a link L310. Said first sensor configuration 310 may comprise a light illuminating detection configuration. Said first sensor configuration 310 may comprise a laser warner unit. Said first sensor configuration 310 is arranged to continuously determine if the vehicle is illuminated by a threat by means of a light signal, for example laser light for positioning determination. Said first sensor configuration 310 may further be arranged to determine a threat on the basis of said detected illumination. This may for example be performed by means of frequency analyses and amplitude analyses of the detected light. Said determining of threat may comprise determining of information about type of the threat. Said determination of threat may be performed by means of said first sensor configuration 310 and/or said control unit 200. Said determination of threat may be performed by means of said first sensor configuration 310 and/or said control unit 200 together with information which is stored in advance in a memory in the control unit 200.

The control unit 200 is arranged for communication with a second sensor configuration 320 via a link L320. Said second sensor configuration 320 may comprise an audio detecting configuration. Said second sensor configuration 320 may comprise an acoustic sensor. Said second sensor configuration 320 is arranged to continuously determine if the vehicle is hit by from a threat sent audio signal, for example ultra sound for positioning determination. Said second sensor configuration 320 may further be arranged to determine a threat on the basis of said detected audio signal. This may for example be performed by means of frequency analyses and amplitude analyses of the detected sound. Said determining of threat may comprise determining of information about type of the threat. Said determination of threat may be performed by means of said second sensor configuration 320 and/or said control unit 200. Said determination of threat may be performed by means of said second sensor configuration 320 and/or said control unit 200 together with information which is stored in advance in a memory in the control unit 200.

The control unit 200 is arranged for communication with a third sensor configuration 330 via a link L330. The third sensor configuration 330 may comprise a radar unit 290. Said radar unit may comprise a radio emitter for sending radio waves for determining positioning information for a threat and/or changes of positioning information of a threat. Said radar unit may comprise a radio receiver for receiving radio waves for determining positioning information about a threat and/or changes of positioning information of a threat. Said threat may be a mobile threat or a fixed positioned threat. Said mobile threat may be for example a tank, a ship. Said fixed positioned threat may be a rigidly mounted artillery system or a bunker.

The control unit 200 is arranged for communication with a fourth sensor configuration 340 via a link L340. Said fourth sensor configuration 340 may comprise at least one visual sensor, for example a camera, video camera or IR camera. Said visual sensor may comprise a light amplifier.

Said fourth sensor configuration 340 is arranged to continuously determine pictures of a surrounding of the vehicle. Said pictures of the surrounding may be used for determining positioning information of a potential threat. Said fourth sensor configuration 340 may further be arranged to determine a threat on the basis of said detected pictures of the surroundings. This may for example be performed by means of image processing of determined pictures of the surroundings. Said determining of threat may comprise determining of information about type of said threat. Said determining of threat may be performed by means of said fourth sensor configuration 340 and/or said control unit 200. Said determining of threat may be performed by means of said fourth sensor configuration 340 and/or said control unit 200 together with information which is stored in advance in a memory in the control unit 200.

The control unit 200 and/or the safety unit 210 may be arranged for communication with a support means configuration (not shown) via a therefore adapted link (not shown). Said support means configuration may comprise navigation equipment of any suitable kind. Said navigation equipment may comprise a suitable number of gyros. Said navigation equipment may comprise a GPS-unit. The control unit 200 and/or the safety unit 210 may be arranged to continuously receive signals comprising information from said support means configuration. The control unit 200 may be arranged to use information from the support means configuration in a suitable way according to an aspect of the present invention.

The control unit 200 is arranged for communication with said first counter-measure configuration 350 via a link L350. Said first counter-measure configuration 350 may comprise a hard-kill system.

The security unit 210 is arranged for communication with said first counter-measure configuration 350 via a link L385. The safety unit 210 is arranged to, where applicable, send a signal comprising information about activating said first counter-measure configuration 350. Hereby the control unit 200 may according to an example only control affect by means of said first counter-measure configuration 350 if said safety unit 210 has activated said first counter-measure configuration 350 by means of said signal.

Said first counter-measure configuration 350 may comprise a system for neutralizing a threat. Said first counter-measure configuration 350 may comprise an anti-aircraft system. According to an embodiment said first counter-measure configuration 350 may comprise an anti-aircraft system comprising anti-aircraft missiles.

The control unit 200 is arranged for communication with a second counter-measure configuration 360 via a link L360. Said second counter-measure configuration 360 may comprise a hard-kill system.

The security unit 210 is arranged for communication with said second counter-measure configuration 360 via a link L386. The safety unit 210 is arranged to, where applicable, send a signal comprising information about activating said second counter-measure configuration 360.

Hereby the control unit 200 may according to an example only control affect by means of second counter-measure configuration 360 if said safety unit 210 has activated said second counter-measure configuration 360 by means of said signal.

According to an embodiment said second counter-measure configuration 295 may comprise an active armour. The control unit 200 may be arranged to activate and/or control said active armour. Said activation may be performed by on the basis of the determined threat and thereto associated threat characteristics. Said activation may according to an embodiment only be performed after that the said safety circuit 210 is given a go ahead by means of the signal 51.

According to an embodiment said second counter-measure configuration 360 may comprise an automatic or semi-automatic so called hard-kill system. Said hard-kill system may comprise an anti-missile system.

The control unit 200 is arranged for communication with a third counter-measure configuration 370 via a link L370. Said third counter-measure configuration 370 may comprise a soft-kill system.

The safety unit 210 is arranged for communication with said third counter-measure configuration 370 via a link L387. The safety unit 210 is arranged to, where applicable, send a signal comprising information about activating said third counter-measure configuration 370. Hereby the control unit 200 may according to an example only control affect by means of third counter-measure configuration 370 if said safety unit 210 has activated said third counter-measure configuration 350 by means of said signal.

Said third counter-measure configuration 370 may comprise a smoke projectile configuration. The control unit 200 may be arranged to fire at least one smoke projectile for achieving a camouflaging smoke. A number of smoke projectiles may be fired simultaneously. An operator may control the provision of smoke in a suitable manner, for example by determining which direction a smoke projectile will be fired. An operator may control the provision of smoke in a suitable manner, for example by determining how far a smoke projectile will be fired. According to an alternative a number of smoke projectiles may be fired intermittently. The control unit 200 may be arranged to provide camouflaging smoke in a close proximity of the vehicle 100 in a suitable way. Said at least one smoke projectile may be fired by an operator of the vehicle 100 by means of therefore dedicated equipment. According to an embodiment said at least one smoke projectile may, where applicable, be fired automatically on the basis of a determined threat and thereto connected threat characteristics, where said safety unit 210 has given a go ahead according to an aspect of the present invention.

According to an embodiment said third counter-measure configuration 370 may comprise an automatic or semi-automatic system, which is adapted to fool for example incoming heat seeking robots by manipulation of heat signature. According to an embodiment said third counter-measure configuration 370 may be arranged to cool the vehicle 100 in a suitable way, such as to a temperature corresponding to a surrounding temperature for reducing risk of detection by means of a IR camera of said threat.

According to an embodiment said third counter-measure configuration 370 may comprise a suitable optical camouflage. Said optical camouflage may automatically or semi-automatically be activated and deactivated on the basis of said determined threat and thereto associated threat characteristics. Said activation may be performed according to an embodiment only after that said safety circuit 210 has given a go ahead by means of the signal 51.

According to an embodiment said third counter-measure configuration 370 may comprise suitable blending equipment for blending a threat. Said threat may be a hostile soldier with a grenade rifle or grenade launcher.

According to an embodiment said third counter-measure configuration 370 may comprise suitable deterring equipment to deter a threat. Said threat may be a hostile soldier with a grenade rifle or grenade launcher. Said deterring equipment may for example comprise an amplifier and a loud speaker for providing very grossly sound, which may be unpleasant for said threat.

According to an embodiment said third counter-measure configuration 370 may comprise suitable equipment for by example electro-magnetic interference. Hereby said third counter-measure configuration 370 may comprise equipment for generating and sending an electromagnetic pulse towards a threat for destroying electronic equipment of said threat.

According to an embodiment said third counter-measure configuration 370 may comprise suitable equipment for by example interference with radar units of said threat.

According to an embodiment said third counter-measure configuration 370 may comprise IR torches and/or metal strips to disillusion said threat in a suitable way.

The control unit 200 is arranged to, where applicable, automatically control said first, second and/or third counter-measure configuration, according to an aspect of the present invention.

Different functions of said counter-measure configurations may be used simultaneously, alone or in combination.

Figure 4A:
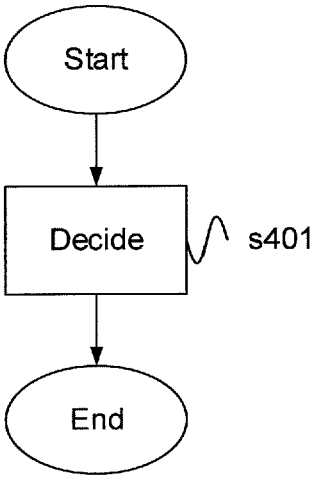
FIG. 4*a* schematically illustrates a flow chart of a method for threat handling of a ground based vehicle, according to an embodiment of the invention.

FIG. 4*a* schematically illustrates a flow chart of a method for threat handling of a ground based vehicle, according to an aspect of the invention. The method comprises a first method step s401. The step s401 comprises the steps of:

- providing at least two kinds of systems for said threat handling, where said threat handling comprises determining information about said threat and determining actions for handling of said threat depending on said information;
- providing a control unit for controlling provided systems;
- providing a separate hardware safety configuration unit; and
- feeding said separate hardware safety configuration unit with by means of provided systems determined information about said threat for in an evaluation step deciding if said control unit should be given a go ahead for handling said threat or not. After the step s401 the method ends.

Figure 4B:
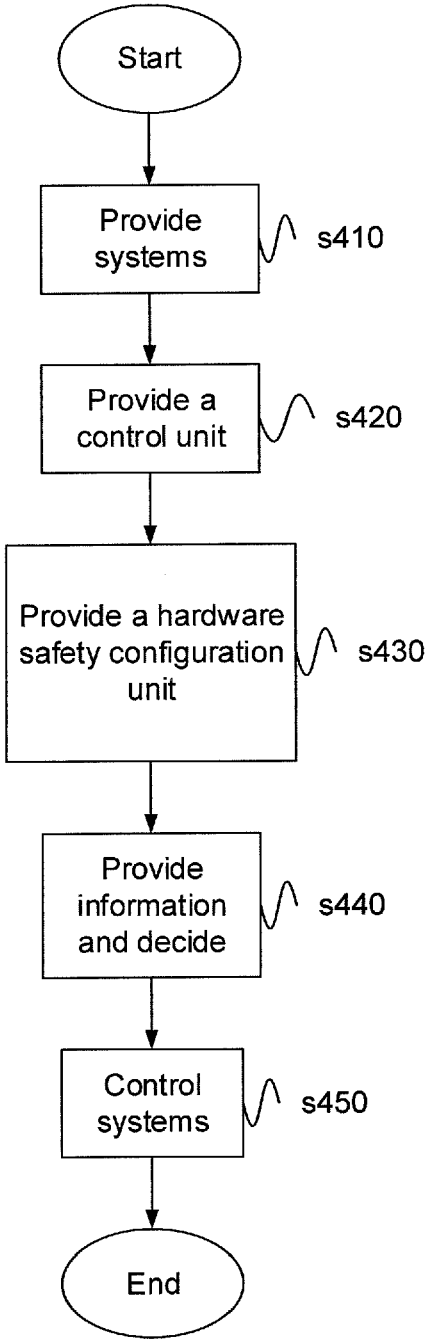
FIG. 4*b* schematically illustrates in greater detail a flow chart of a method for threat handling of a ground based vehicle, according to an embodiment of the invention.

FIG. 4*b* schematically illustrates a flow chart of a method for threat handling of a ground based vehicle, according to an embodiment of the invention.

The method comprises a first method step s410. The method step s410 comprises the step of providing at least two kinds of systems for said threat handling, where said threat handling comprises determining information about said threat and determining actions for handling said threat depending on said information. Said two kinds of systems may be hard-kill system respectively soft-kill system. After the method step s410 a subsequent step s420 is performed.

The method step s420 comprises the step of providing a control unit 200 for controlling provided systems. Said control unit 200 comprises software for, on the basis of received signals from different sensor configurations, such as the sensor configurations 310, 320, 330 and 340 controlling said provided systems. After the method step s420 a subsequent method step s430 is performed.

The method step s430 comprises a step of providing a separate hardware safety configuration unit 310. Said hardware safety configuration unit 310 is arranged to, where applicable, send a signal 51 to said control unit, which signal 51 comprises information about allowed actions, for example using of a hard-kill system or a soft-kill system for handling a determined threat in a suitable way. After the method step s430 a subsequent method step s440 is performed.

The method step s440 comprises the step of providing said separate hardware safety configuration unit 210 with information about said threat determined by means of provided systems for in a an evaluation step deciding if said control unit should be given a go ahead for handling said threat or not. Hereby at least one of the first, second, third and fourth sensor configuration may provide information about threat and/or threat characteristics associated with said threat. After the method step s440 a subsequent method step s450 is performed.

The method step s450 comprises the step of by means of said control unit controlling provided systems for automatic handling of said threat and/or semi-automatic handling of said threat. Said controlling is performed on the basis of information from said hardware safety configuration unit 210. After the method step s450 the method ends.

Figure 5:
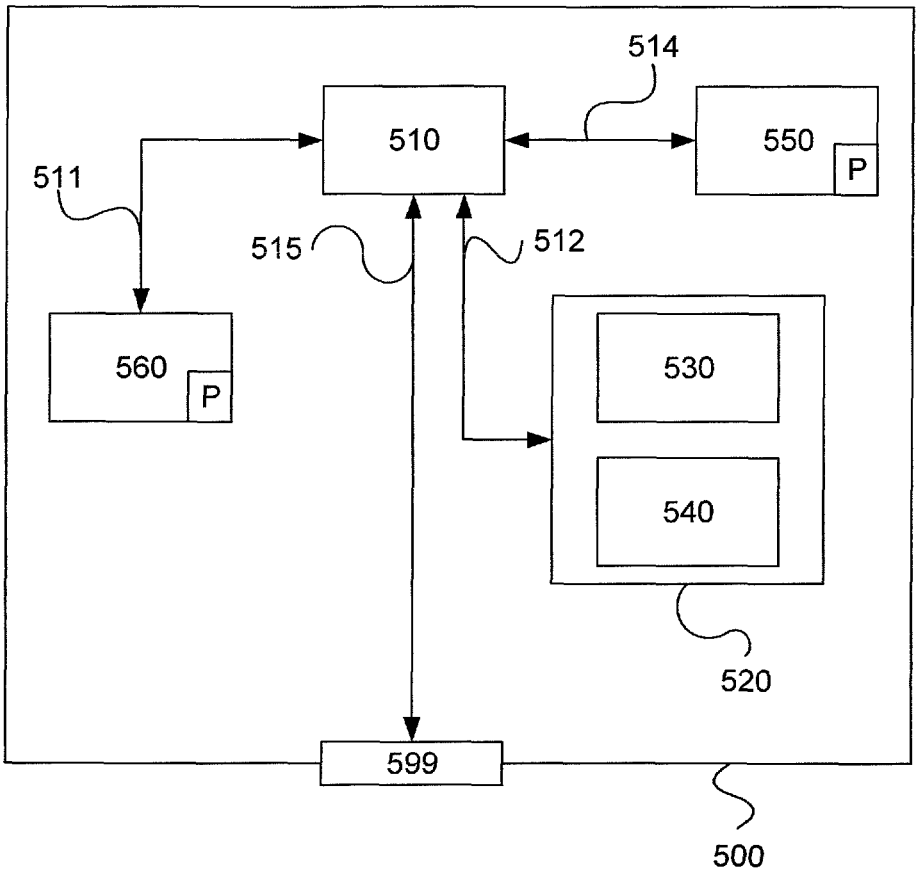
FIG. 5 schematically illustrates a computer, according to an embodiment of the invention.

With reference to FIG. 5 a diagram of an embodiment of a device 500 is illustrated. The control units 200 and 210 described with reference to FIG. 2 may in one version comprise the device 500. The device 500 comprises a non-volatile memory 520, a data processing unit 510 and a read/write memory 550. The non-volatile memory 520 has a first memory element 530 in which a computer program, such as an operating system, is stored for controlling the function of the device 500. The device 500 further comprises a bus controller, a serial communication port, IO means, an A/D converter, a time- and date input- and transfer unit, an event counter and an interruption controller (not depicted). The non-volatile memory 520 has also a second memory element 540.

There is provided a computer program P comprising routines for threat handling of a ground based vehicle according to the innovative method. The computer program P comprises routines for determining information about said threat. The computer program P comprises routines for determining actions for handling of said threat depending on said information. The computer program P comprises routines for controlling provided systems, for example the first system 250 and the second system 260 for automatic and/or semi-automatic handling of said threat on the basis of a by means of a separate hardware safety configuration unit 210 determined decision about if a go ahead should be given for handling said threat or not.

The program P may be stored in an executable form or in a compressed form in a memory 560 and/or in a read/write memory 550.

When the data processing unit 510 is described as performing a certain function it means that the data processing unit 510 affects a certain part of the program stored in the memory 560, or a certain part of the program stored in the read/write memory 550.

The data processing device 510 can communicate with a data port 599 via a data bus 515. The non-volatile memory 520 is arranged for communication with the data processing unit 510 via a data bus 512. The separate memory 560 is arranged for communication with the data processing unit 510 via a data bus 511. The read/write memory 550 is adapted for communication with the data processing unit 510 via data bus 514. The data port 599 may for example have the links L210, L250*a*, L260*b*, L300, L350, L360 and L370 connected to it (see FIG. 2 and FIG. 3).

When data received on the data port 599 they are stored temporarily in the second memory element 540. When received input data have been temporarily stored, the data processing unit 510 is prepared to affect code execution as described above. According to one embodiment signals received on the data port 599 comprises information about a go ahead for handling a certain threat. According to an embodiment signals received on the data port 599 comprises information determined by the first sensor configuration 310, second sensor configuration 320, third sensor configuration 330 and fourth sensor configuration 340. According to an embodiment signals received on the data port 599 comprises information determined by the first counter-measure configuration 350, second counter-measure configuration 360 and/or third counter-measure configuration 370. The signals received on the data port 599 may be used by the device 500 for handling a determined threat.

Parts of the methods herein described may be affected by the device 500 by means of the data processing unit 510 which runs the program stored in the memory 560 or the read/write memory 550. When the device 500 runs the program the methods herein described are executed.

The foregoing description of the preferred embodiments of the present invention is provided for illustrative and descriptive purposes. It is not intended to be exhaustive or to restrict the invention to the variants described. Many modifications and variations will obviously be apparent to one skilled in the art. The embodiments have been chosen and described in order best to explain the principle of the invention and its practical applications and hence make it possible for specialists to understand the invention for various embodiments and with the various modifications appropriate to the intended use.

The invention claimed is:

1. A method for threat handling of a ground based vehicle, comprising the steps of:

providing a first system and a second system, the first system and the second system configured to handle a threat;

providing a sensor for determining information about the threat;

providing a controller for controlling the provided systems and for determining actions for handling the threat depending on the information;

providing a separate hardware safety configuration unit; and providing the separate hardware safety configuration unit with the information about the threat determined by the provided sensor so as to in an evaluation step decide if the controller should be given a go ahead for handling the threat or not, wherein the information determined by the provided sensor is shared between the controller and the separate hardware safety configuration unit.

2. The method of claim 1, wherein the first system comprises a hard-kill system for defeating a threat and the second system comprises a soft-kill system for avoiding a threat.

3. The method of claim 1, wherein said vehicle is a combat vehicle.

4. The method of claim 1, further comprising the step of by means of the controller, controlling the provided systems for automatic handling of the threat and/or semi-automatic handling of the threat.

5. The method of claim 1, further comprising the step of connecting the hardware safety configuration unit as well as the controller to the provided systems for transferring information.

6. The method of claim 5, wherein information transferring from said hardware safety configuration unit to the controller is one-directional.

7. The method of claim 1, wherein the controller is configured to be provided with information from one of the provided systems for controlling another of the provided systems.

8. A device for threat handling of a ground based vehicle, comprising:

a first system and a second system, the first system and the second system configured to handle a threat;

a sensor adapted to determine information about the threat;

a controller configured to control the systems arranged for determining actions for handling of the threat depending on the information; and a separate hardware safety configuration unit, wherein the sensor is configured to provide the separate hardware safety configuration unit with information about the threat determined by the sensor, wherein the separate hardware safety configuration unit is configured to decide if the controller should be given a go ahead for handling the threat or not, and wherein the information determined by the provided sensor is shared between the controller and the separate hardware safety configuration unit.

9. The device of claim 8, wherein the first system is a hard-kill system configured to defeat a threat, and wherein the second system is a soft-kill system configured to avoid a threat.

10. The device of claim 8, wherein said vehicle is a combat vehicle.

11. The device of claim 8, wherein the controller is configured to control the systems for automatic handling of the threat and/or semi-automatic handling of the threat.

12. The device of claim 8, further comprising a connection configuration adapted to connect the hardware safety configuration unit as well as the controller to the provided systems for transferring information.

13. The device of claim 12, wherein said hardware safety configuration unit is configured for one directional information transfer to the controller.

14. The device of claim 8, wherein the controller is configured to receive information from one of the provided systems and to control another of the provided systems on the basis of the received information.

15. A vehicle comprising the device of claim 8.

16. The vehicle of claim 15, wherein said vehicle is one of an armoured vehicle, terrain vehicle or other military vehicle.

17. A non-transitory computer readable medium having stored therein a computer program for threat handling of a ground based vehicle, when executed the computer program causing an electronic controller to perform the steps of:

determining information about the threat;

determining actions for handling the threat depending on the information; and controlling at least one of a first system and a second system for automatic and/or semi-automatic handling of the threat based upon a decision determined by a separate hardware safety configuration unit, the decision comprising whether a go ahead should be given for handling the threat or not, wherein the information is shared between the controller and the separate hardware safety configuration unit.

18. A non-transitory computer readable medium having stored therein a computer program which, when executed, performs the steps of:

determining information about the threat;

determining actions for handling the threat depending on the information; and controlling at least one of a first system and a second system for automatic and/or semi-automatic handling of the threat based upon a decision determined by a separate hardware safety configuration unit, the decision comprising whether a go ahead should be given for handling the threat or not, wherein the information is shared between the controller and the separate hardware safety configuration unit.

* * * * *